United States Patent [19]

Desmond et al.

[11] 3,942,711

[45] Mar. 9, 1976

[54] DECORATIVE CARTON CLOSURE

[75] Inventors: John D. Desmond; Joseph J. Hart, both of Philadelphia, Pa.

[73] Assignee: Container Corporation of America, Chicago, Ill.

[22] Filed: Mar. 28, 1975

[21] Appl. No.: 563,063

[52] U.S. Cl. ..... 229/39 R; 229/41 B; 229/87 R

[51] Int. Cl.[2] ..... B65D 5/10

[58] Field of Search ..... 229/37 R, 38, 39, 41 R, 229/41 B, 87 R

[56] References Cited

UNITED STATES PATENTS

| | | | |
|---|---|---|---|
| 2,327,709 | 8/1943 | Himes | 229/39 R |
| 2,538,860 | 1/1951 | Buttery | 229/41 B |
| 2,927,720 | 3/1960 | Adams | 229/41 B X |
| 3,257,068 | 6/1966 | Wright | 229/38 X |
| 3,366,304 | 1/1968 | Peckar et al. | 229/37 R X |
| 3,443,739 | 5/1969 | Adams, Jr. | 229/39 R |
| 3,790,064 | 2/1974 | Kramer | 229/39 R |
| 3,851,815 | 12/1974 | Desmond et al. | 229/37 R |

FOREIGN PATENTS OR APPLICATIONS

| | | | |
|---|---|---|---|
| 1,320,181 | 1/1963 | France | 229/39 R |

*Primary Examiner*—William Price
*Assistant Examiner*—Stephen Marcus
*Attorney, Agent, or Firm*—Carpenter & Ostis

[57] ABSTRACT

A tubular decorative carton closure arrangement including a plurality of overlapping top closure flaps which automatically fold into interlocking relation when the carton is erected.

1 Claim, 8 Drawing Figures

DECORATIVE CARTON CLOSURE

BACKGROUND OF THE INVENTION

Field of the Invention

The invention relates to decorative cartons which are printed and folded in such a way as to simulate cartons with separate, decorative paper overwraps.

SUMMARY OF THE INVENTION

The present invention represents an advantage over the known prior art, because it prevents the exposure of raw edges of certain of the closure flaps by additional folds, without the necessity of covering the raw edges of the paperboard by a separate decorative overwrap. This, of course, reduces the cost of these types of decorative cartons without sacrificing the desirable decorative appearance.

DRAWINGS

It will be understood that, for purposes of clarity, certain elements may have been intentionally omitted from certain views where they are believed to be illustrated to better advantage in other views.

SPECIFICATION

It is contemplated that the carton embodying the invention described herein will be formed from paperboard which has been printed with a decorative pattern, so that when the carton is erected, it will have the appearance of a gift package which has been overwrapped with decorative paper or film.

Figure 1:
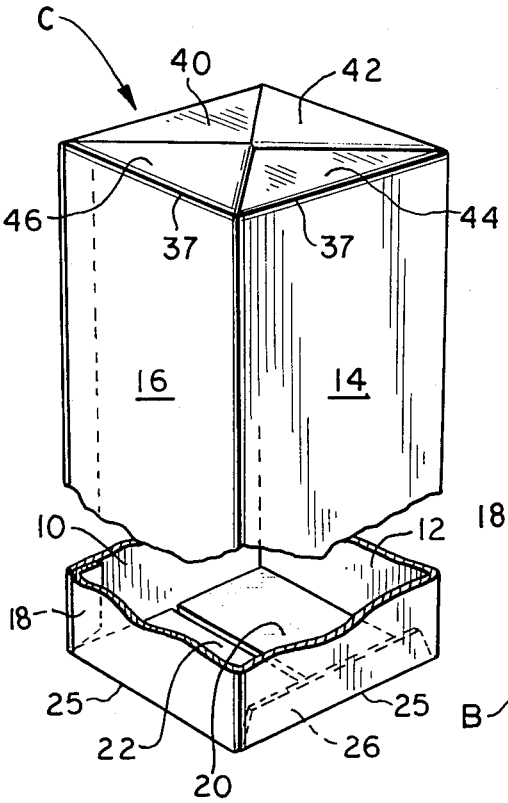
FIG. 1 is an exploded perspective view of an erected carton embodying features of the invention.
Figure 2:
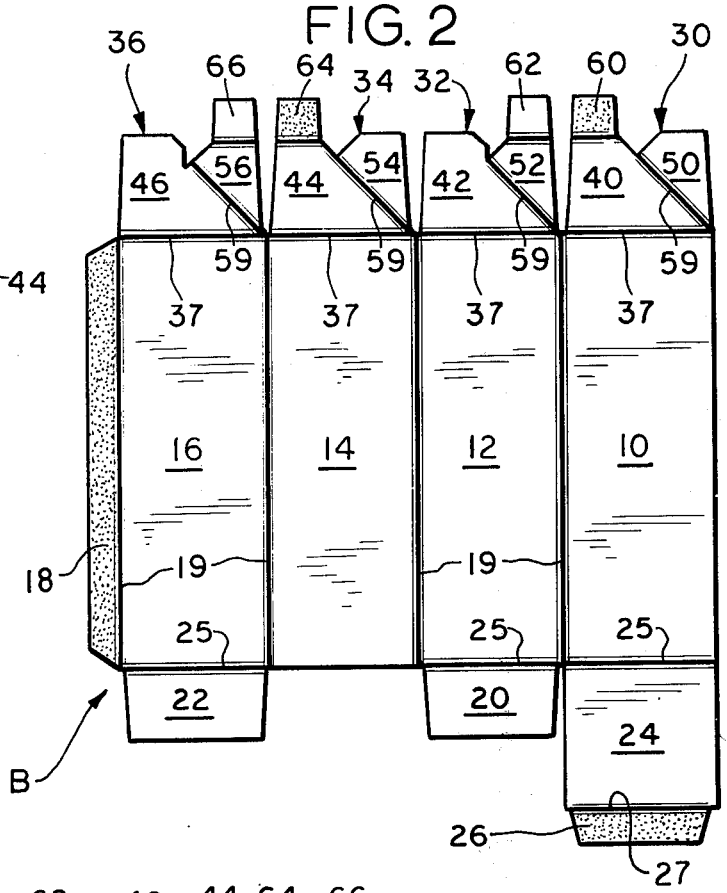
FIG. 2 is a plan view of the outside surface of the paperboard blank from which the carton illustrated in the other views may be formed.

Referring now to the drawings for a better understanding of the invention, it will be seen that the novel, decorative, gift-type carton indicated generally at C in FIG. 1 may be formed from the unitary blank B of foldable paperboard illustrated in FIG. 2.

Referring now particularly to FIG. 2, it will be seen that the blank B includes a plurality of side wall panels 10, 12, 14, and 16, and a glue panel 18 which are hingedly attached to each other on parallel score lines 19, with glue panel 18 secured to first side wall panel 10 to form a tubular structure open at the ends.

As the novel closure arrangement of the invention relates to the upper portion of the carton, it will be understood that the lower portion or bottom end of the carton may be closed in any desired manner. In the embodiment illustrated in the drawings, for example, there are provided a pair of inner closure flaps 20, and

22, and an outer closure flap 24 which are hingedly attached to the lower edges of side wall panels 12, 16, and 10, respectively, along common hinge lines 25. Outer closure flap 24 may be provided with an additional glue tab or tuck tab 26 hingedly attached to the free edge thereof on hinge line 27. The bottom closure flaps may be folded into overlapped relation to close the bottom of the carton in the manner illustrated in FIG. 1 of the drawings.

Referring now to the top closure arrangement, as best seen in FIG. 2, the carton is provided with top closure flaps 40, 42, 44, and 46, which are hingedly attached to the upper edges of side wall panels 10, 12, 14, and 16, respectively, along common hinge lines 37.

It will be noted that each of the top closure flaps includes a pair of major and minor sections, the major sections of flaps 30, 32, 34, and 36 being designated by the numerals 40, 42, 44, and 46, respectively, and the minor sections of flaps 30, 32, 34, and 36 being designated by the numerals 50, 52, 54, and 56, respectively. The minor sections of each flap are hinged to their related major sections along parallel fold lines 59, all of which extend at an angle of less that 90° with respect to score lines 19 and hinge lines 37.

Each of the top closure flaps has one section with presents a free outer edge extending generally parallel to the related hinge line 37. In the case of closure flaps 40 and 44, the free edge referred to is on the minor section; whereas, in the case of closure flaps 42 and 46, the free edge referred to is on the major section. Also, each of the top closure flaps has one section which presents an extension which projects outwardly beyond the free edge on the other of its sections. Top closure flaps 30 and 34 have projections 60 and 64 projecting from their major flaps 40 and 44, respectively; whereas, top closure flaps 32 and 36 have projections 62 and 66 projecting from their minor sections 52 and 56, respectively.

Figure 3:
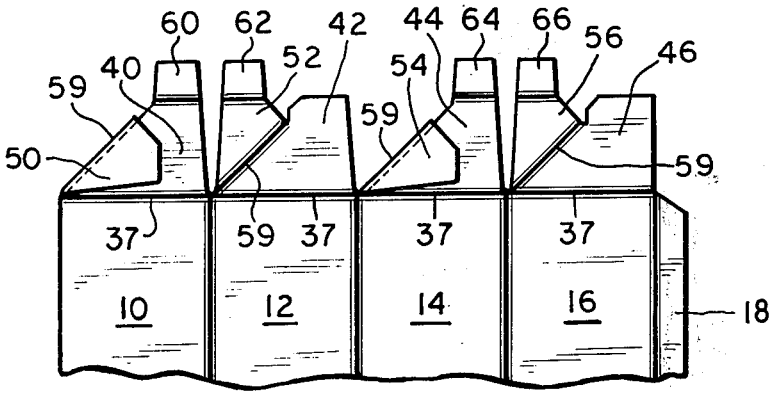
FIGS. 3 and 4 are fragmentary views of portions of the inside surface of structure illustrated in FIG. 1, showing the manner in which the closure flaps are folded in forming the carton.
Figure 4:
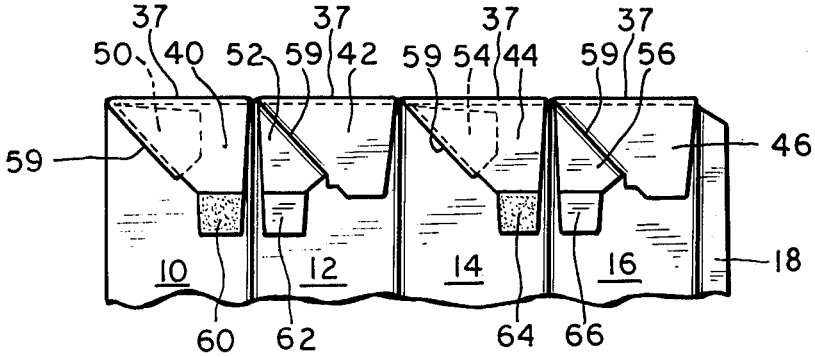
Figure 5:
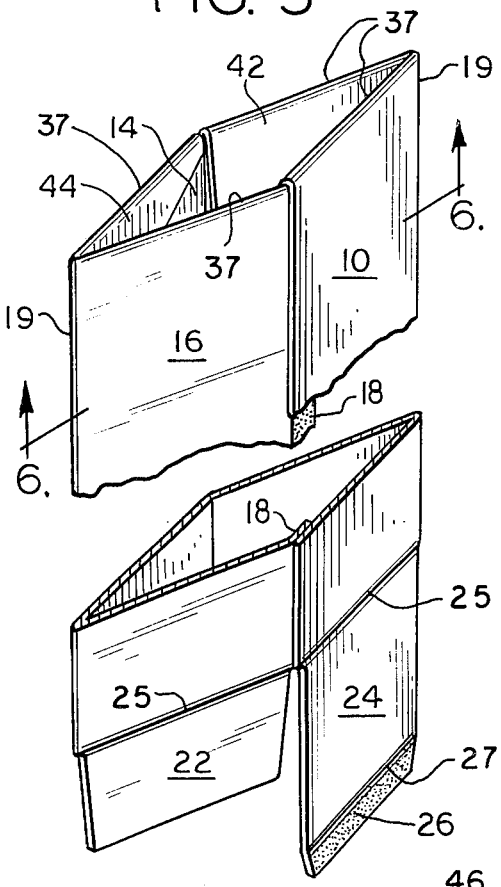
FIG. 5 is a view similar to FIG. 1, but showing the carton in a partially erected condition.
Figure 8:
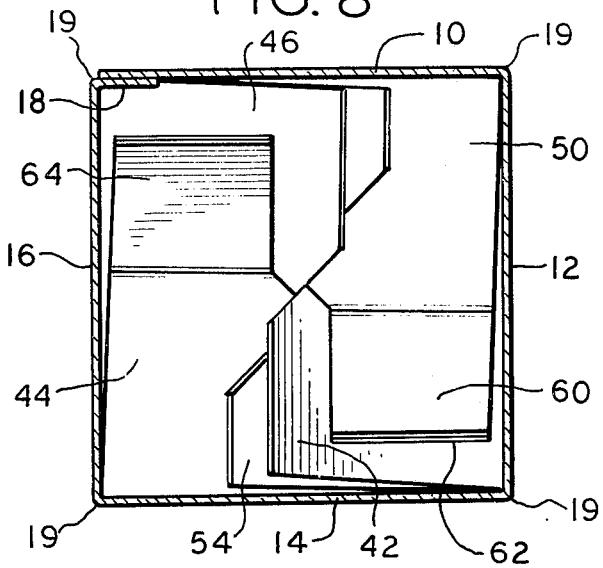
FIG. 8 is a view similar to that of FIG. 7, but showing the inside of the upper end of the carton in a completely erected condition.

In forming the carton, it will be noted that minor sections 50 and 54 of flaps 30 and 34 are folded over 180° and secured to their related major sections 40 and 44, respectively, as shown in FIG. 3 of the drawings. All of the top closure flaps are then folded inwardly 180° against the inner faces of their related side wall panels, as shown in FIG. 4. Adhesive is then applied to projections 60, 62, 64, and 66 and glue panel 18, so that when the blank, as shown in FIG. 4, is folded over upon itself, a glued, collapsed carton is formed of the type illustrated in FIG. 5.

Figure 6:
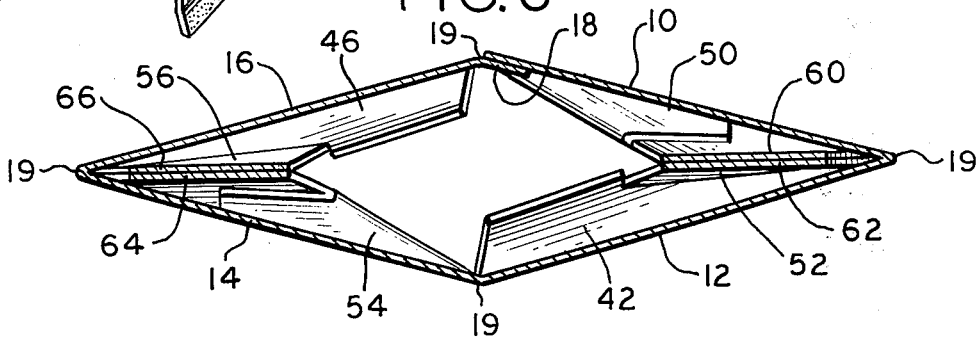
FIG. 6 is a transverse, horizontal sectional view taken on line 6—6 of FIG. 5.
Figure 7:
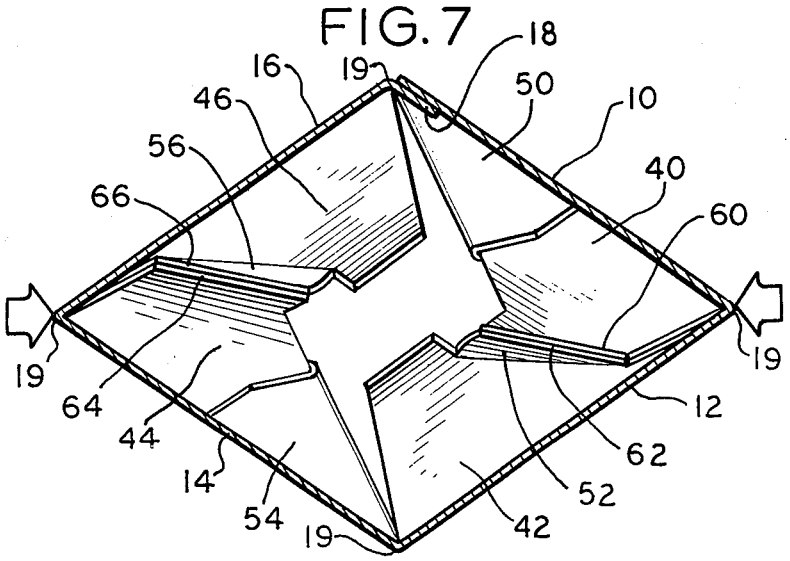
FIG. 7 is a fragmentary plan view of the structure illustrated in FIG. 6.

When the carton is ready for use by the customer, it is erected by the application of pressure against diagonally opposed corners, as shown in FIG. 6, which causes the upper closure flaps to be folded sequentially into overlapped relationship to form a flat or level upper wall of the carton, as seen in FIG. 1. The carton may then be loaded from the bottom, and the bottom closure flaps closed in the conventional manner to form the bottom closure illustrated in FIG. 1.

It will be understood that by providing the minor closure flaps 50 and 54 to be folded over onto their related major sections, all of the raw edges of the top closure flaps are concealed, so that the top of the carton has the appearance of a carton that has been overwrapped with a decorative wrap.

We claim:

1. In an automatic end closure arrangement for a collapsible, decorative carton formed from a unitary blank of foldable paperboard, the combination of:

a. opposed first and second pairs of side walls hingedly interconnected on parallel score lines to form a tubular structure open at one end;

b. opposed first and second pairs of closure flaps hingedly attached to related end edges of said first and second pairs of side walls, respectively;

c. each of said closure flaps including a major section, hingedly attached at one edge thereof to a related side wall on a hinge line extending in a direction normal to said score lines, and a minor section, hingedly attached to another edge of said major section along a fold line extending at an angle of less than 90° with respect to said score and hinge lines;

d. each of said closure flaps having one of said sections presenting a free outer edge extending generally parallel to said hinge line and having the other of said sections presenting an extension projecting beyond said free edge of said one section;

e. said first pair of closure flaps having said extensions on their respective major sections, and said second pair of closure flaps having said extensions on their respective minor sections;

f. said minor sections of said first pair of closure flaps being folded 180° on said fold lines and being secured in face-to-face relation with their respective major sections to prevent the exposure of raw edges of said closure flaps from the outside of said carton;

g. said extensions on each of said first pair of closure flaps being secured in face-to-face relation with respective extensions on said second pair of closure flaps, so that when the carton is moved from a collapsed condition to an erected condition, all of said closure flaps will automatically be folded sequentially into overlapped relationship to close said one end of said tubular structure.

* * * * *